US007743589B2

(12) United States Patent
Dominique et al.

(10) Patent No.: US 7,743,589 B2
(45) Date of Patent: Jun. 29, 2010

(54) RIDING SADDLE AND ITS METHOD OF MANUFACTURE

(75) Inventors: Benjamin Stéphen Pierre Dominique, Passy (FR); Laurent Duray, Nontron (FR)

(73) Assignee: Sellerie de Nontron, Nontron (FR)

( * ) Notice: Subject to any disclaimer, the term of this patent is extended or adjusted under 35 U.S.C. 154(b) by 226 days.

(21) Appl. No.: 11/949,223

(22) Filed: Dec. 3, 2007

(65) Prior Publication Data

US 2008/0134647 A1 Jun. 12, 2008

(30) Foreign Application Priority Data

Dec. 1, 2006 (FR) ..... 06 10565

(51) Int. Cl.
*B68C 1/02* (2006.01)

(52) U.S. Cl. ..... 54/44.1

(58) Field of Classification Search ..... 54/44.1, 54/44.3, 44.5, 44.7, 66
See application file for complete search history.

(56) References Cited

U.S. PATENT DOCUMENTS

| | | | | |
|---|---|---|---|---|
| 483 | A | 11/1837 | Payne | |
| 4,745,734 | A * | 5/1988 | Brown | 54/44.7 |
| 7,178,318 | B2 * | 2/2007 | Swain | 54/44.7 |
| 7,246,478 | B2 * | 7/2007 | Fairfax | 54/44.1 |

FOREIGN PATENT DOCUMENTS

DE 147409 C 5/1902

OTHER PUBLICATIONS

French Preliminary Search Report dated Jun. 25, 2007.

* cited by examiner

*Primary Examiner*—Rob Swiatek
(74) *Attorney, Agent, or Firm*—Young & Thompson

(57) ABSTRACT

A riding saddle provided with a semirigid tree (1) is remarkable in that it includes a semirigid trapezium (2) facing the back (50) of the horse and on which the saddle is placed, which trapezium cooperates with the tree (1).

13 Claims, 1 Drawing Sheet

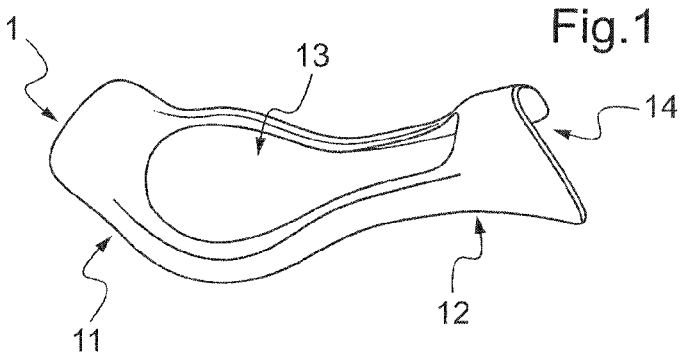
Fig.1
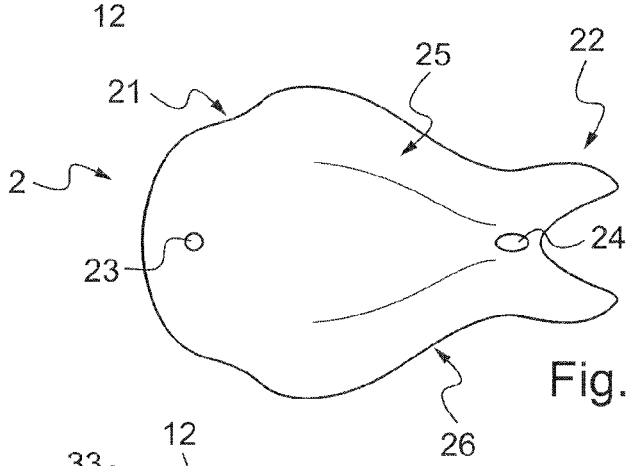
Fig.2
Fig.3
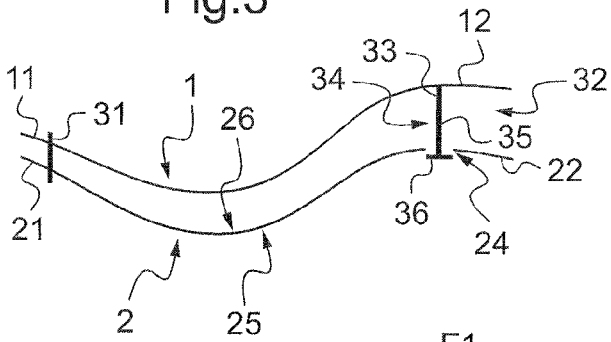
Fig.4
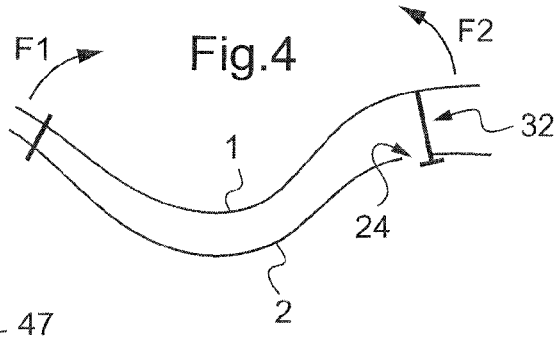
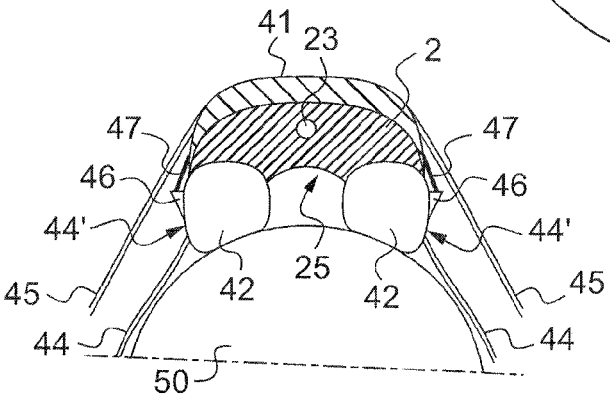
Fig.5

RIDING SADDLE AND ITS METHOD OF MANUFACTURE

The present invention relates to a riding saddle and to its method of manufacture.

BACKGROUND OF THE INVENTION

In traditional manner, a saddle comprises two panels extended by sweat flaps, the sweat flaps having the function of protecting the horse's flanks, in particular to avoid them coming into contact with girth buckles.

The panels constitute pads that come into contact with the horse's back. By way of example, these panels serve to soften contact so as to avoid pressure points that can generate pain and fatigue for the horse.

The panels are connected to each other by a flexible piece of leather referred to as a "trapezium". This trapezium constitutes a piece that faces the horse's back but that does not touch it since it is spaced apart therefrom by the panels of the saddle.

Thereafter, on top of the trapezium, there is the strength member of the saddle, referred to as the "tree". The tree is a rigid part made up of two curved portions known as the pommel and as the cantle that are located respectively in anterior and posterior zones of the saddle. By means of its rigidity, the tree serves to clear the horse's withers and also to maintain the shape of the saddle.

In addition, the tree is generally hollow in its center. Straps are then stretched across the tree so as to form a seat, the straps serving to support the padding and the traditional leather covering on which the rider sits.

In addition, the tree is also fitted with girth straps serving to secure a girth of the saddle that goes round the horse's body so as to hold the saddle on the horse.

Similarly, the tree has flaps on its outside, that cover the sweat flaps and the girth straps. They are not only attractive in appearance, but they also provide the rider's legs with contact with the saddle and the horse. To improve this contact, the flaps are provided with ridges that guide the legs.

Finally, the tree is also provided with stirrup bars that enable the stirrups that receive the rider's feet to be fastened to the saddle.

Such saddles are entirely conventional and satisfy requirements. Nevertheless, their method of fabrication is sometimes difficult and lengthy, which can lead to cost that is not negligible.

Furthermore, it can be seen that a riding saddle has only one rigid element, i.e. the leather-covered tree. Given the movements of the horse, that architecture necessarily leads to rough contacts and to significant impacts between the saddle and the rider, which can be uncomfortable or can even give rise to injury.

For example, when trotting, the rider rises slightly from the saddle and then drops back onto the saddle, in such a manner as to off-load the back of the horse on every other stride given that the rider is not sitting on the saddle on every other stride.

Nevertheless, dropping back into the saddle gives rise to a repeated impact that can be disagreeable for the rider and also for the horse.

OBJECTS AND SUMMARY OF THE INVENTION

An object of the present invention is to propose a riding saddle that makes it possible to obviate the above-mentioned limitations, and more particularly to avoid giving rise to impacts.

According to the invention, a riding saddle provided with a tree that is semi-rigid is remarkable in that it also has a trapezium that is semi-rigid, facing the back of the horse on which the saddle is placed, and co-operating with the tree.

Since the trapezium is semi-rigid, it is not constituted merely by a piece of leather. For example, it is made using a composite material provided with glass and carbon fibers, polyurethane foam, and resins. The same preferably applies to the semi-rigid tree.

The use of such a material combines several advantages, such as stiffness, strength, suitability for being adjusted, and it is also light in weight, which is not negligible for the purpose of sparing the horse's back. Furthermore, the material can deform to a reasonable extent without breaking, which is advantageous under present circumstances.

In addition, since the trapezium is semi-rigid, it can co-operate with the tree so as to enable shocks to be damped.

Advantageously, the tree is movable relative to the trapezium. As a result the tree and trapezium assembly also constitutes means for damping impacts, unlike in the prior art where that assembly is constituted a single strength member fitted with a flexible piece of leather. It will be understood that the movement of the tree relative to the trapezium is suitable for damping the impacts encountered when the horse is trotting, for example, the tree and trapezium assembly dissipating the vertical force by giving rise to a horizontal displacement.

In a first variant of the invention, the semi-rigid tree and the semi-rigid trapezium of the saddle are substantially identical in shape, the tree matching the shape of the trapezium when a rider is sitting on the saddle.

In a second variant of the invention, in order to enable the tree to move in a horizontal direction relative to the trapezium, the posterior portions of the tree and of the trapezium are secured to each other by engagement means. The posterior portion of the tree, i.e. its rear portion pointing towards the horse's tail, is thus fastened to the posterior portion of the trapezium via the engagement means, which secure the tree to the trapezium in their posterior portions.

In contrast, the anterior portion of the tree is movable relative to the anterior portion of the trapezium in a horizontal direction, i.e. a direction extending substantially along the axis of the horse's spine.

Thus, the posterior portion of the tree is secured to the posterior portion of the trapezium, while the anterior portion thereof is suitable for moving relative to the trapezium in a horizontal direction.

Advantageously, the anterior portion of the tree is suitable for performing a horizontal displacement over a maximum length of 2.5 centimeters (cm) in such a manner as to obtain significant damping.

Consequently, the anterior portions of the tree and of the trapezium are interconnected by a link that puts a limit on the stroke available.

By way of example, the link constitutes slider means comprising a pin having a first end that is secured to the tree and a second end that passes through an orifice formed in the trapezium. The first end is an insert arranged in the tree, while the pin is a screw passing through the orifice and screwed into the insert. The head of the screw then constitutes a stop acting as an abutment for limiting vertical displacement of the tree.

In addition, the orifice in the trapezium is preferably an oblong hole that enables said link to be displaced, the oblong hole having a maximum length of 2.5 cm.

Consequently, when the rider sits on the saddle, that imparts a vertical force on the tree and on the trapezium. They both tend to deform, with their posterior and anterior portions moving towards each other, substantially describing an arc of a circle. During this movement, the link is displaced horizontally in the oblong hole that thus constitutes a slideway. The relative movement between the anterior portion of the tree relative to the anterior portion of the trapezium that results therefrom enables the energy generated by said vertical force to be dissipated, so that the semi-rigid tree and trapezium assembly then constitutes means for damping impacts.

Finally, the trapezium is optionally provided with two panels including reinforcement of composite material firstly for making the panels easier to assemble, and secondly for ensuring that pressure points do not appear on the horse's back.

The present invention also provides a method of fabricating a riding saddle comprising a semi-rigid tree provided with flaps and a semi-rigid trapezium provided with panels. The method is remarkable in that the following steps are performed in succession:

a) a seat is fabricated from the semi-rigid tree, by placing the elements of the seat on said tree, namely the girth straps, the flaps, and the sweat flaps;

b) a frame is fabricated by fixing the panels of the saddle to the trapezium, the trapezium being semi-rigid; and c) the saddle is completed by fastening the seat on the frame.

In order to save time, it is possible for steps a) and b) to be implemented simultaneously.

In a variant of the method, panels are used that include rigid reinforcement made of composite materials, for example, and provided with inserts. A screw being conventionally provided with a head and a shank, during step b), each panel is fastened to the trapezium via at least one screw, the shank of the screw passing through the trapezium to be screwed into the panel, and the head of the screw being arranged against the top face of the trapezium which facing the tree of the saddle.

Assembly is thus very easy to perform. It is also easy to change the panels.

Advantageously, during a preliminary stage of step c), for at least one panel being provided with a pocket on its outside face, i.e. a face of the panel that is not directed towards the flank of the horse, and for the tree including at least one point, i.e. a fastener tab, said point is inserted in the pocket.

The pocket thus enables the seat to be properly positioned relative to the frame before they are fastened together definitively.

In addition, during a final stage of step c), optionally following the preliminary stage, the posterior portion of the semi-rigid trapezium is fastened to the posterior portion of the tree via engagement means, constituted by a screw having its shank screwed into an insert present in the tree.

Similarly, during this final stage of step c), the anterior portion of the semi-rigid trapezium is connected to the anterior portion of the tree via a link such as a pin of the tree passing through an orifice of the trapezium in the form of an oblong hole, the first end of the pin being secured to the tree, while its second end projects from the trapezium and is terminated by a stop.

It should be observed that the various variants of the invention as described above are compatible with one another.

BRIEF DESCRIPTION OF THE DRAWING

The invention and its advantages appear in greater detail in the context of the following description which relates to preferred embodiments given without any limiting character and with reference to the accompanying figures, in which:

FIG. 1 is a diagrammatic side view of a tree;

FIG. 2 is a diagrammatic view from beneath of a trapezium of the invention;

FIGS. 3 and 4 are a diagrammatic section of a tree arranged on a trapezium in accordance with the invention; and FIG. 5 is a diagrammatic hind view of a saddle for illustrating the method of the invention.

Elements present in more than one figure are given the same references in each of them.

MORE DETAILED DESCRIPTION

FIG. 1 is a diagrammatic view of a tree 1. The tree 1 is semi-rigid presenting a posterior portion 11, i.e. at the rear of the saddle, and thus remote from the horse's withers.

Furthermore, the tree is provided with an anterior portion 12, i.e. beside the horse's withers. It should also be observed that the tree possesses a rounded end 14 for allowing the horse's withers to move vertically.

Furthermore, there can be seen an opening 13 in the tree, the center of the tree being hollow. The opening 13 is then filled with straps on which the padding and covering of the saddle will rest.

It is explained below that other elements such as the flaps and the girth straps are also secured to the tree 1 so as to constitute a first assembly referred to for convenience, as a "seat".

FIG. 2 is a diagrammatic view from beneath of a trapezium 2 of the invention. It can be seen that this trapezium is a semi-rigid plate and not just a piece of leather.

The trapezium 2 comprises a posterior portion 21 situated at the rear of the saddle and thus remote from the horse's withers. In addition, the trapezium 2 is provided with an anterior portion 22 beside the horse's withers.

Furthermore, the trapezium possesses a bottom face 25 facing the horse's back and a top 26 facing the tree 1.

Furthermore, in order to secure the tree 1 to the trapezium 2, the trapezium is provided with an orifice in the form of an oblong hose 24 in its anterior portion and with a round hole 23 in its posterior portion.

FIG. 3 is a diagrammatic section of a tree 1 arranged on a trapezium 2, the said tree 1 co-operating with the trapezium 2.

The posterior portion 11 of the tree 1 is secured to the posterior portion 21 of the trapezium 2 via engagement means 31, e.g. a screw that passes through the round hole 23 of the trapezium 2 to be screwed into an insert present in the tree 1. The top face 26 of the trapezium 2 then faces towards said tree 1. The engagement means 31 serve to secure the tree 1 to the trapezium 2 at their posterior portions 11, 21.

Similarly, the anterior portion 12 of the tree 1 is fastened to the anterior portion 22 of the trapezium 2 via a link 32.

By way of example, the link 32 is a pin having its first end 33 constituted by an insert secured to the tree 1. Its second end 34 is then a screw whose shank 35 projects from the trapezium 2, the screw head 36 facing the bottom face 25 of the trapezium 2.

The tree 1 then co-operates with the trapezium 2, and vice versa.

At rest, and with reference to FIG. 3, the tree 1 is spaced apart from the trapezium 2 in natural manner, given the way the posterior portions of the tree 1 and the trapezium 2 are fastened together via the engagement means.

In contrast, with reference to FIG. 4, when a rider sits on the saddle, the tree 1 is free to move at least in part relative to the trapezium 2, so the tree 1 is displaced and comes substantially to fit the shape of the trapezium 2. More precisely, the weight of the rider deforms the tree 1 and the trapezium 2 elastically.

Their posterior and anterior portions are then displaced respectively along arrows F1 and F2. Furthermore, the tree 1 is movable relative to the trapezium 2, with the link 32 being displaced horizontally in the oblong hole 24.

The combination of these movements thus imparts a non-negligible damping power to the assembly comprising the tree 1 and the trapezium 2.

Furthermore, a particularly useful and unexpected result is observed. The horizontal movement of the anterior portion of the tree causes pressure points on the horse's back to be distributed uniformly, thus greatly relieving the horse.

The oblong shape of the oblong hole 24 in the trapezium 2 serves to avoid the shank 35 of the screw 34 coming into contact with the sides of the hole. The oblong hole thus serves both as a guide and also as a stroke limiter. In FIG. 4, it can be seen that the displacement of the tree is limited in the end by the pair comprising the oblong hole 24 and the link 32, with the link 32 coming into abutment against the oblong hole at the end of its travel.

It should be observed that using composite materials for fabricating the tree is particularly effective, insofar as such composite materials make it possible to obtain a tree that is semi-rigid, sufficiently rigid to constitute the reinforcement of the saddle, but also sufficiently flexible to be deformed without that breaking the tree. Advantageously, the same applies to the trapezium 2.

FIG. 5 is a diagrammatic hind view of a saddle placed on the back 50 of a horse, for the purpose of illustrating the method of the invention. The cantle of the saddle can be seen particularly clearly.

During a step a) of the method, the seat of the saddle is fabricated from a semi-rigid tree that is not visible in FIG. 5.

The hollow portion 13 of the tree 1 is initially filled with straps and then the tree 1 is covered in padding and a covering 41, e.g. made of leather.

Furthermore, using means that are not shown in the figures, two flaps 45 are installed on the sides of the tree to enable riders to grip the saddle. Similarly, it can be seen that the anterior portion of the tree is provided with two fixing tabs known as "points" 47.

Finally, girth straps (not shown) are fastened to the tree for the purpose of attaching the girth for holding the saddle on the horse, with the girth then going round the body of the horse.

In addition, the tree is also fitted with stirrup bars (not shown) for securing the stirrup leathers to the saddle.

At the end of this step a), all of the component elements of the seat have thus been assembled.

During step b), optionally performed simultaneously with step a), the frame of the seat is fabricated.

The frame is provided with a semi-rigid trapezium 2 with each of its sides including a respective panel 42.

These panels 42 are stuffed with padding and they are arranged on the back 50 of the horse.

In addition, the panels 42 are reinforced with rigid reinforcement of composite materials, with threaded inserts (not shown) being arranged in the reinforcements. Thus, each panel is fastened to the trapezium 2 via at least one screw passing through the trapezium and being received in an insert in the panel.

It should be observed that the head of each of these screws is disposed on the top face 26 of the trapezium, i.e. the face of the trapezium that faces the tree and not the back of the horse. This feature is important since it makes it possible to eliminate pressure points on the back 50 of the horse, thereby improving the horse's comfort.

Furthermore, a sweat flap 44 is fastened on each panel 42. Similarly, each panel 42 includes a pocket 46, on an outside face 44', i.e. a face of the panel that does not face towards a flank of the horse.

Step b) is then complete.

Consequently, during a step c), following steps a) and b), the saddle is completed by fastening the seat to the frame.

During a preliminary stage of step c, the fixing tabs 47 of the seat are inserted into the pockets 46 of the sweat flap 44. This serves in particular to position the seat properly relative to the frame.

Thereafter, during a final stage of step c), the posterior portion of the tree is fastened to the posterior portion of the trapezium 2 using the engagement means 31. The engagement means 31 are constituted by a screw, for example, passing through the round hole 23 in the trapezium 2, and screwed into an insert that is secured to the tree.

In addition, the anterior portion 12 of the tree 1 is connected to the anterior portion 22 of the trapezium 2 via a link 32. More precisely, the link 32 is constituted for example by an insert 33 secured to the tree 1 and by a screw 34. The screw then passes through an oblong hole 24 in the trapezium 2 so as to be screwed into the insert 33 of the tree 1, with a portion of the screw, including its head 36, thus projecting from the trapezium 2 out from the saddle.

Naturally, the present invention can be subjected to numerous variants as to its implementation. Although several variants are described above, it will readily be understood that it is not conceivable to identify exhaustively all possible variants. It is naturally possible to envisage replacing any of the means described by equivalent means without going beyond the ambit of the present invention.

What is claimed is:

1. A riding saddle provided with a semi-rigid tree (1) and a semirigid trapezium (2) co-operating with said tree (1), said trapezium (2) facing the back (50) of a horse on which said saddle is placed, wherein anterior portions (12, 22) of said tree and trapezium (1 and 2) are interconnected by a link (32) having an axis with a first end secured to the tree and a second end that passes through an orifice (24) in said trapezium (2), said orifice (24) being an oblong hole.

2. A saddle according to claim 1, wherein said semirigid tree and trapezium (1 and 2) are identical in profile, said tree (1) matching the shape of said trapezium (2) whenever a rider sits on said saddle.

3. A saddle according to claim 1, wherein said tree (1) is movable relative to said trapezium (2), said tree (1) serving as means for damping impacts.

4. A saddle according to claim 1, wherein the posterior portions (11, 21) of said tree and trapezium (1 and 2) are fastened together by engagement means (31).

5. A saddle according to claim 1, wherein the anterior portion (12) of said tree (1) is movable relative to the anterior portion (22) of said trapezium (2).

6. A saddle according to claim 5, wherein said anterior portion (12) of said tree (1) is suitable for performing horizontal displacement relative to said trapezium (2) over a maximum length of 2.5 cm.

7. A saddle according to claim 1, wherein the oblong hole has a maximum length of 2.5 cm.

8. A saddle according to claim 1, wherein said trapezium (2) is provided with two panels (42), said panels (42) including reinforcement made of composite material.

9. A method of fabricating a riding saddle comprising a semirigid tree (1) provided with flaps (45) and a trapezium (2) provided with panels (42); wherein the following steps are performed:

a) a seat is fabricated from said tree (1) by placing seat elements on said tree (1);

b) a frame is fabricated by fastening said panels (42) to said trapezium (2), said trapezium (2) being semirigid; and c) said saddle is completed by fastening said seat on said frame, by connecting during a final stage of step c), an anterior portion (22) of said trapezium (2) to an anterior portion (12) of the tree (1) via a pin of the tree (1) passing through an oblong hole in the trapezium (2), a first end of said pin being secured to said tree (1) while a second end of said pin projects from said trapezium (2) and is terminated by a stop.

10. A method according to claim 9, wherein steps a) and b) are implemented simultaneously.

11. A method according to claim 9, wherein at least one screw is provided with a head and a shank being used during step b) to fasten each panel (42) to said trapezium (2), the shank of said at least one screw passing through said trapezium (2) to fasten the screw to said panel (42), the head of the screw being arranged on a top face (26) of the trapezium (2) facing the tree (1) of the saddle.

12. A method according to claim 9, wherein during a preliminary stage of step c), at least one panel (42) is provided with a pocket (46) on an outside face (44') and the tree (1) having at least one point (47), said at least one point (47) is inserted into said pocket (46).

13. A method according to claim 9, wherein during a final stage of step c), the posterior portion (21) of said trapezium (2) is fastened to the posterior portion (11) of the tree (1) via a screw whose shank is screwed into an insert present in said tree (1).

* * * * *